US005193812A

United States Patent [19]

Hendricksen

[11] Patent Number: 5,193,812

[45] Date of Patent: Mar. 16, 1993

[54] GOLF CLUB WITH LASER ALIGNMENT SYSTEM

[76] Inventor: Mark W. Hendricksen, E. 10805 22nd Ave., Spokane, Wash. 99206

[21] Appl. No.: 870,051

[22] Filed: Apr. 15, 1992

[51] Int. Cl.[5] ..... A63B 69/36

[52] U.S. Cl. ..... 273/186.3; 273/163 R

[58] Field of Search ..... 273/186 A, 186.3, 187.4, 273/187.5, 163 R, 163 A, 164.1, 164.2

[56] References Cited

U.S. PATENT DOCUMENTS

| | | | |
|---|---|---|---|
| 3,953,034 | 4/1976 | Nelson | 273/186.3 |
| 4,367,877 | 1/1983 | Gibson et al. | 273/187.4 |
| 4,997,189 | 3/1991 | Perkins | 273/181 H |
| 5,029,868 | 7/1991 | Cloud | 273/186 A |

*Primary Examiner*—George J. Marlo
*Attorney, Agent, or Firm*—Mark W. Hendricksen

[57] ABSTRACT

A golf club with a laser alignment system which can be built into the club or which can be attachable and detachable. The golf club includes a shaft, a grip and a clubhead. The alignment system includes a laser beam generator and facilitates the emission of the laser beam in a direction perpendicular to and above the clubface and above the desired location on the clubface for striking the golf ball. Also provided is a way to attach the laser beam point of emission to the clubhead in a position above the level of the ball and such that it is projected over the vertical height of the golf ball and perpendicular to the clubface.

20 Claims, 13 Drawing Sheets

GOLF CLUB WITH LASER ALIGNMENT SYSTEM

FIELD OF THE INVENTION

This invention generally pertains to golf clubs and a means to align the clubface to the intended target by projecting a laser beam in a direction perpendicular to the clubface.

BACKGROUND OF THE INVENTION

The popularity of the game of golf as a participation sport has proliferated over the past several years. Golf is played with three types of clubs which are generally referred to as woods, irons and putters. The term wood generally refers to a mallet-type headed club. With the increased use of metal alloys and other materials for use in the construction of the head, the term wood may now be somewhat misleading as they are often times now called metal woods.

There are several elements in and variables to the swinging of a golf club and hitting a golf ball in the intended direction of flight. The accuracy in the direction of the golf ball's flight plays a significant role in the players score and in his stress level while trying to relax on the golf course.

The most significant element which determines the direction of the flight of the golf ball is the alignment of the clubface with respect to the intended target or direction of flight at the time of impact. It is intended for the clubface to be perpendicular to the intended target at impact.

Naturally, a golfers alignment prior to beginning his or her swing is very important in the ultimate alignment when striking the ball, especially for the part of the game referred to as putting. A golfer's ability to align his or her clubface to the desired target is largely a function of each golfer's ability to visually determine if the clubface is aligned perpendicular to the desired target or direction.

Many golfers' eyesight inhibits their ability to accurately align the clubface so that it is perpendicular to the target prior to beginning the swing, i.e. when addressing the ball. In many golfer's view, misalignment of the clubface when addressing the ball prior to the swing is the cause of many inaccurate shots and consequently many additional strokes, especially when putting.

In an attempt to assist golfers in visually aligning their clubface properly, many manufacturers have placed accentuated and elongated lines on their putters to assist the golfer in aligning the face of the club in the intended direction. Some manufacturers place these visible direction assistance lines parallel to the putter's hitting surface, while others place the line(s) perpendicular to the putter's hitting surface, while still others place lines both parallel and perpendicular to the putter's hitting surface.

The clubface for most irons only contains grooves in the hitting surface which should appear to the golfer to be perpendicular to a line directly to the intended target.

Substantial time is spent by teaching professionals and others to clubface and body alignment prior to initiating the swing, especially for putting.

Although there are many methods to attempt to properly align the clubface perpendicular to the target, none have heretofore sufficiently allowed the golfer to be assured that the club face is accurately and reliably aligned such that it is exactly or very near perpendicular to the intended target. The result in many cases is the player with the worst vision for alignment or perpendicularity makes fewer shots in the intended direction and consequently, scores higher in a game where that is not the objective.

It is common for golfers who are addressing the ball and ready to initiate their swing to believe that the clubface is aligned to a certain target, when in reality, it is several angular degrees off from where they thought it was. Just a few angular degrees out of alignment on a one hundred and fifty yard shot, or on a twenty five foot putt, can make a substantial difference in the accuracy of the shot.

Due to their inability to visualize perpendicularity or proper clubface alignment, it is oftentimes difficult for golfers with this problem to discover it themselves and to get them into the habit of proper alignment on a consistent basis.

My invention is intended to substantially reduce or eliminate this alignment problem. It is believed that the most dramatic results players will experience will be in the alignment of their putts, although substantial gains can be made using my invention with woods and irons as well.

The golfing industry has heretofore been unable to find a sufficiently reliable solution to the alignment problem.

My invention allows the golfer to first visually align the clubface such that he or she believes the clubface is perpendicular to the intended target, without the aid of the my invention's alignment means. Thereafter, the golfer can generate a laser beam to project a visible line or to project a small dot or pattern in the direction the clubface is aligned. This will give the golfer immediate feedback on the accuracy of his or her visual alignment.

My invention further allows golfers to better develop and render as habit their own method to visually align the golf club on a consistent basis.

SUMMARY OF THE INVENTION

My invention generally includes the typical elements of a golf club, namely a shaft means, a grip means and a clubhead. Additionally, however, my invention provides a golf club with a an alignment system which includes a means to generate a laser beam and a means to emit said beam perpendicular from the clubface and in the specific direction of intended flight.

The means to generate a laser beam generally includes a lasing means and a means to provide electrical current to said lasing means. The preferred lasing means is what it currently referred to as a semiconductor lasing means, or more particularly, a diode laser.

It is an object of this invention to provide a means for golfers to improve their score by improving what many believe to be the most important fundamental of the golf game, namely the alignment of the clubface perpendicular to the intended target. It is an advantage and feature of my invention that the golfer can accurately determine the specific direction the clubface is aligned while addressing the golf ball. My invention will allow golfers to learn better visual alignment of the clubface.

It is a further object of this invention to provide a means for the user to align a golf club while standing over or addressing the golf ball. This will allow the golfer to better train his or her eyes to align the clubface even without the assistance of the laser beam.

It is a further object of this invention to provide a means to align one's golf club much more accurately than methods and apparatuses previously employed, especially at longer distances.

It is a further object of this invention to provide a means for a golf professional to teach golfers to visually align the clubface relative to the target and to point out their student's misalignment problems.

It is a further object of this invention to provide the foregoing in a form which is lightweight enough so that the swinging of the club is not substantially altered or hindered by the addition of the lasing means.

It is a further object of this invention to provide such an alignment system relatively economically and with a relatively simple design.

Other objects, features and advantages of this invention will appear from the specifications, claims and accompanying drawings which form a part hereof. In carrying out the objects of this invention, it is to be understood that its essential features are susceptible to change in design and structural arrangement with only one practical and preferred embodiment being illustrated in the accompanying drawings, as required.

BRIEF DESCRIPTION OF DRAWINGS

In the accompanying drawings which form a part hereof.

DESCRIPTION OF THE PREFERRED EMBODIMENT

This invention generally pertains to a laser beam alignment system for a golf club, which generally includes a grip means, a shaft means, a clubhead, a means to generate a laser beam and a means to emit said laser beam in the desired direction and above a desired a location.

The laser beam is emitted in a direction perpendicular from the clubface and toward the intended target from directly over the location on the clubface where it is desired to strike the ball.

Many of the fastening, connection and wiring means and other components utilized in this invention are widely known and used in the field of the invention described, and their exact nature or type is not necessary for an understanding and use of the invention by a person skilled in the art or science, and they will not therefore be discussed in significant detail.

The various components shown or described herein for any specific application of this invention can be varied or altered as anticipated by this invention. This invention comprises a unique combination of elements, each element of which can be accomplished by one of several different means or variations for a specific application of this invention. The practice of a specific application of any element may already be widely known or used in the art or by persons skilled in the art or science and each will not therefore be discussed in significant detail.

This invention generally includes the basic components of a golf club, which are: a shaft, a grip and a club head. There are many variations and different types of shafts, grips and club heads, most if not all of which can be used in conjunction with my invention.

There are certain variations or modifications which can be made to these generally known components to facilitate different applications of this invention without changing the nature of what is claimed by this invention, as is set forth more fully herein.

Although the majority of the description and drawings contained herein are directed toward the golf club referred to as a putter, this invention is not limited to putters and specifically includes irons and woods (metal woods and "wood" woods), and the description applies equally regardless of what type of club, i.e. putter, iron or wood.

Figure 1:
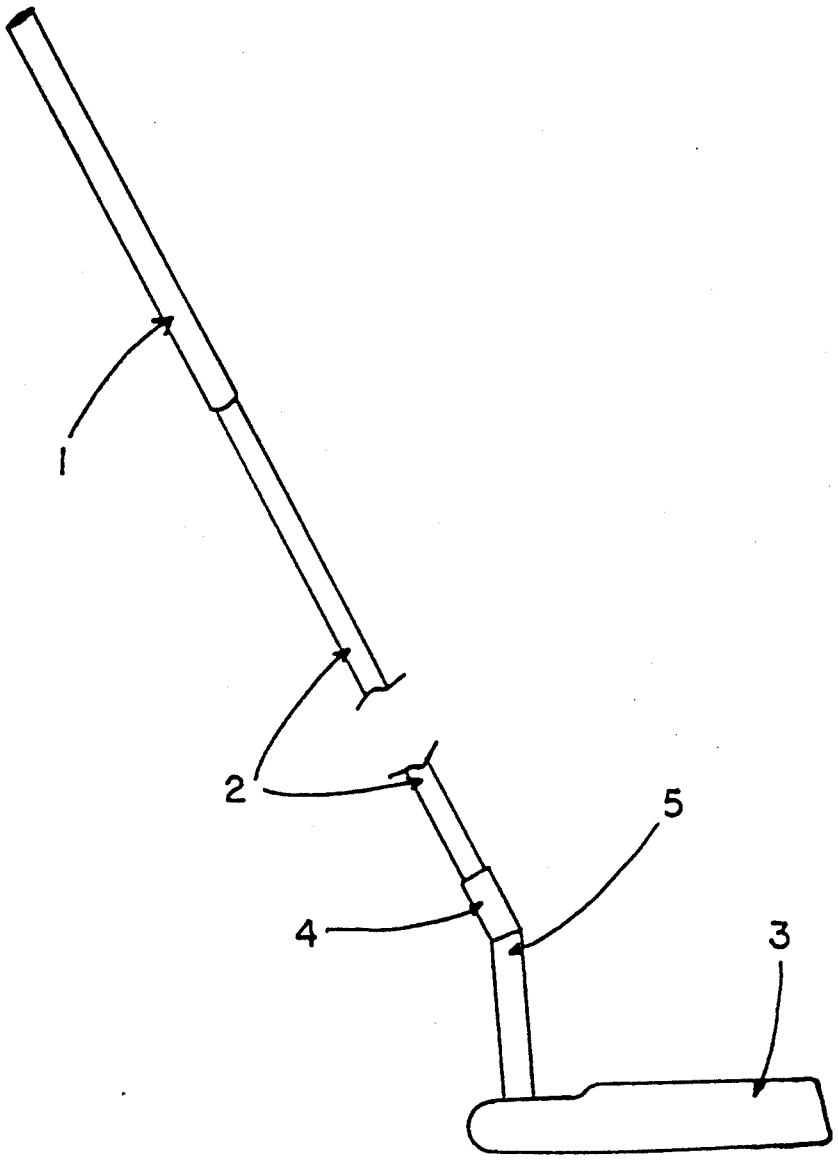
FIG. 1 is a front view of a typical golf club, more particularly, of a putter.

FIG. 1 shows a typical golf club referred to as a putter and its components, namely a grip 1, a shaft 2 and a clubhead 3. FIG. 1 also shows the hosel 4 of the club and the neck 5 of the clubhead.

The grip 1 is a well known product in the industry, with there being numerous different types, any of which can be used to practice this invention.

The shaft 2 can be the same as the shaft for most golf clubs, i.e. a hollow, tubular steel alloys, boron alloys, titanium alloys, graphite, wood and composites. The specific application of this invention desired will determine whether a typical shaft can be used or whether an enlarged diameter shaft must be used, as is more clear in the description of the different applications of this invention.

The clubhead 3 can be any one of the unlimited styles and shapes of golf clubs for the putter application, the iron application and the wood application, with no specific type being required to practice this invention.

Figure 2:
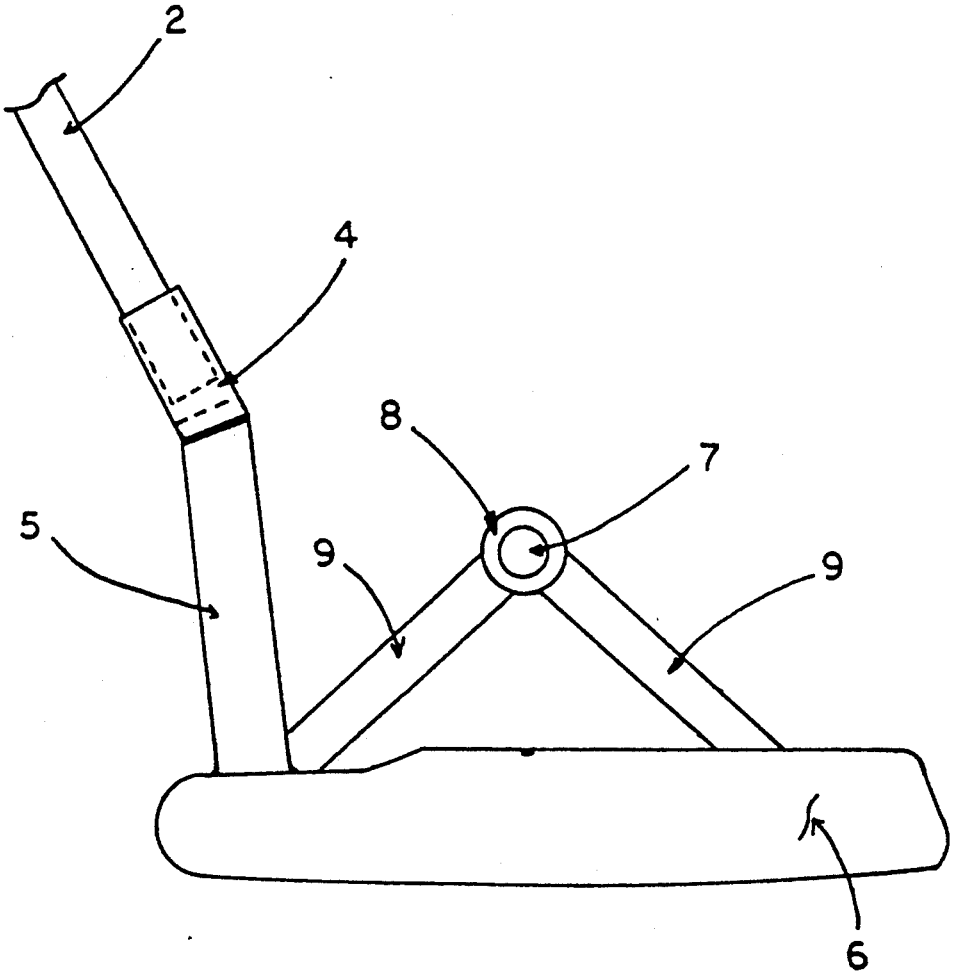
FIG. 2 is a front view of the clubhead of a left handed putter with one application of my laser alignment invention thereon.

FIG. 2 is a front view of a clubhead of putter, showing the shaft 2, the hosel 4 and the neck 5. The clubface 6 of a putter is typically vertically planar.

FIG. 2 also shows one of many possible applications of the laser emission attachment means, which positions the means to emit the laser beam in a direction perpendicular to the clubface and above an approximate location on the clubface where it is desired to strike a golf ball, and which will emit the laser beam in a substantially horizontal plane when the golf club is held for addressing the ball on a horizontal surface.

The means to emit the laser beam within the contemplation of this invention generally includes a means to receive the laser beam from the lasing means or from the fibre optic cable, and a transmission means such as a glass cover or a lens configuration to emit the desired beam. There are several possible variations that can be used to practice this invention.

Figure 3:
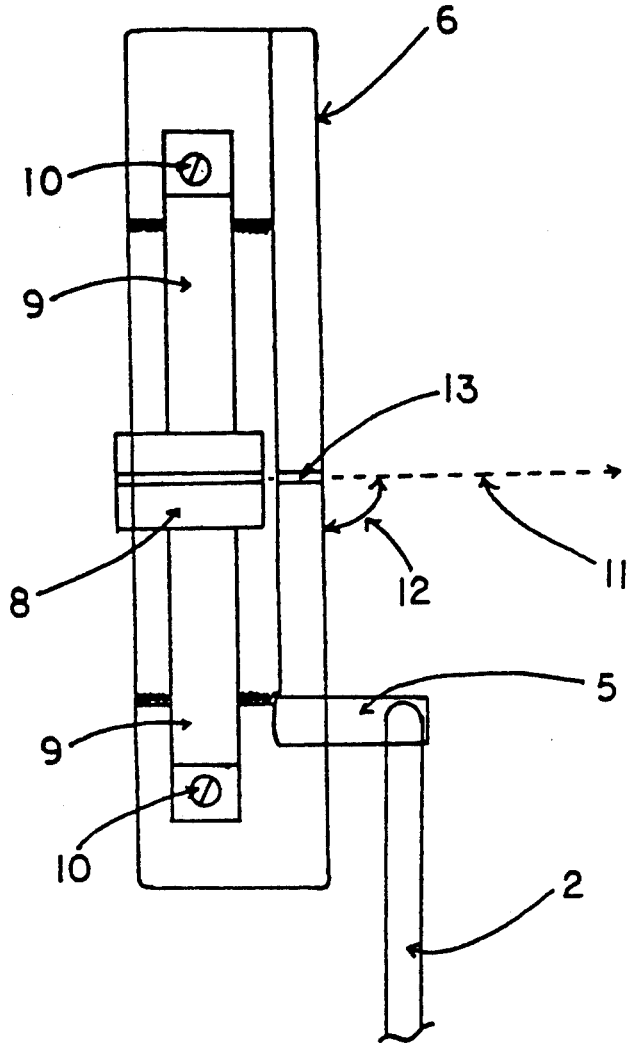
FIG. 3 is a top view of the clubhead of a left handed putter with one application of my laser alignment invention thereon.
Figure 4:
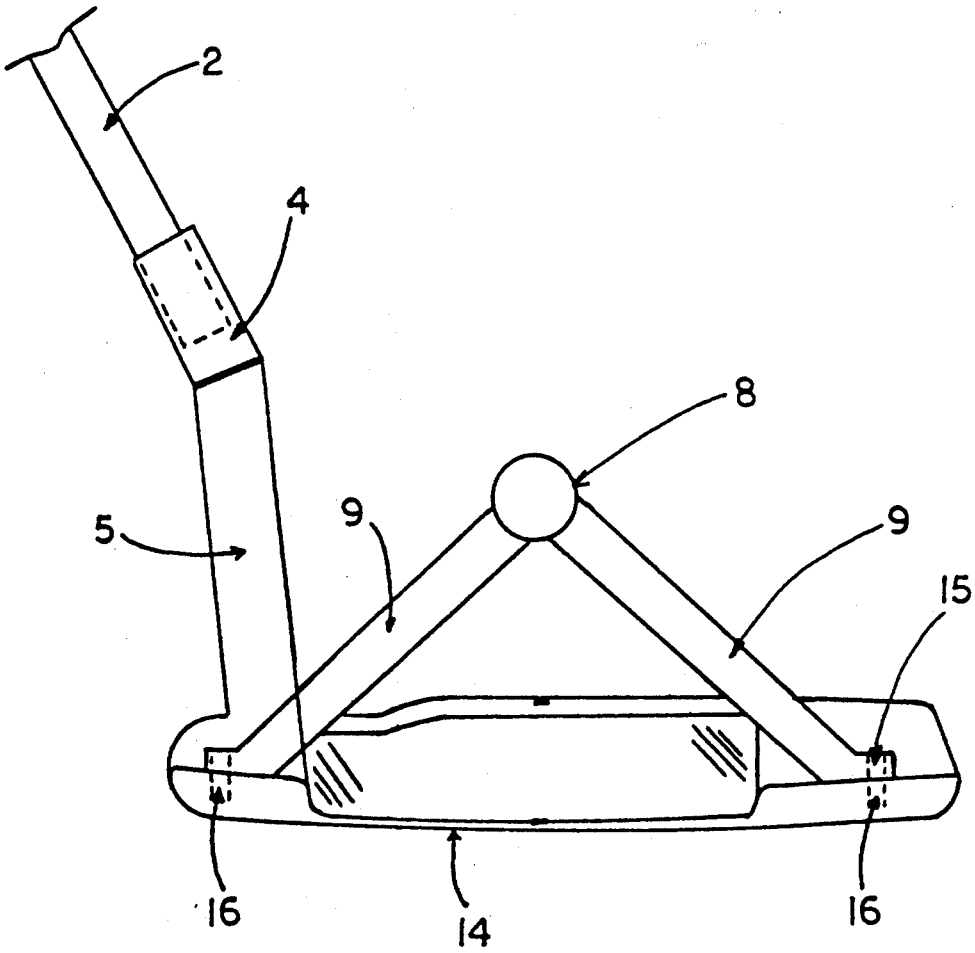
FIG. 4 is a rear view of the clubhead of a putter with one application of my laser alignment invention thereon.

While there are many possible ways to accomplish the laser emission attachment means within the contemplation of this invention, different views of the preferred embodiment at the time of filing this application are shown in FIG. 2, FIG. 3 and FIG. 4.

FIG. 2 shows the emission glass 7, through which the laser beam is emitted, the laser emission housing 8 and the two support members 9 which attach at their upper end to the laser emission housing means 8 and at their lower end to the clubhead 3.

The support members 9 can be attached to the clubhead in numerous ways, such as by known welding or other attachment means. The support members 9 are long enough such that the laser beam 11 is emitted at a vertical level over the top of the golf ball.

Depending on the specific application of this invention and on whether the lasing means is located remote from the point of emission, the laser emission housing means 8 may house different elements. One application may locate the lasing means, the optical means, the means to emit the laser beam and the means to provide electrical current within the housing means 8. Another application may only locate the means to emit the laser beam in the housing means 8 and receive the laser beam from the lasing means and optical means via a fibre optic cable.

FIG. 3 and FIG. 4 show the support members to be attached to the clubhead through the use of one screw 10 through each support member 9, which screws into an internally threaded screw recipient in the clubhead 3.

FIG. 3 shows a dotted line to indicate the path of the emitted laser beam 11, emitted at an angle 12, which is ninety degrees from the horizontal plane of the clubface 3. The linear groove 13 is the indicator on a typical putter clubhead of the desired location to strike the golf ball.

FIG. 4 is a rear view of a putter golf club with my laser alignment system attached thereto. FIG. 4 better shows the sole 14 of the golf club and this application of the location and means of attaching the support members 9 to the putter clubhead 3. The two holes 15 in the structural members receive the screws which secure the support members 9 to the clubhead 3. The two holes 16 shown in FIG. 4, in the clubhead 3 are internally threaded recipients of the screws 11.

An imaginary line between the center line of the two holes 16 shown in FIG. 4, internally threaded recipients of the screws 10, is preferably parallel to the clubface 6.

Figure 5:
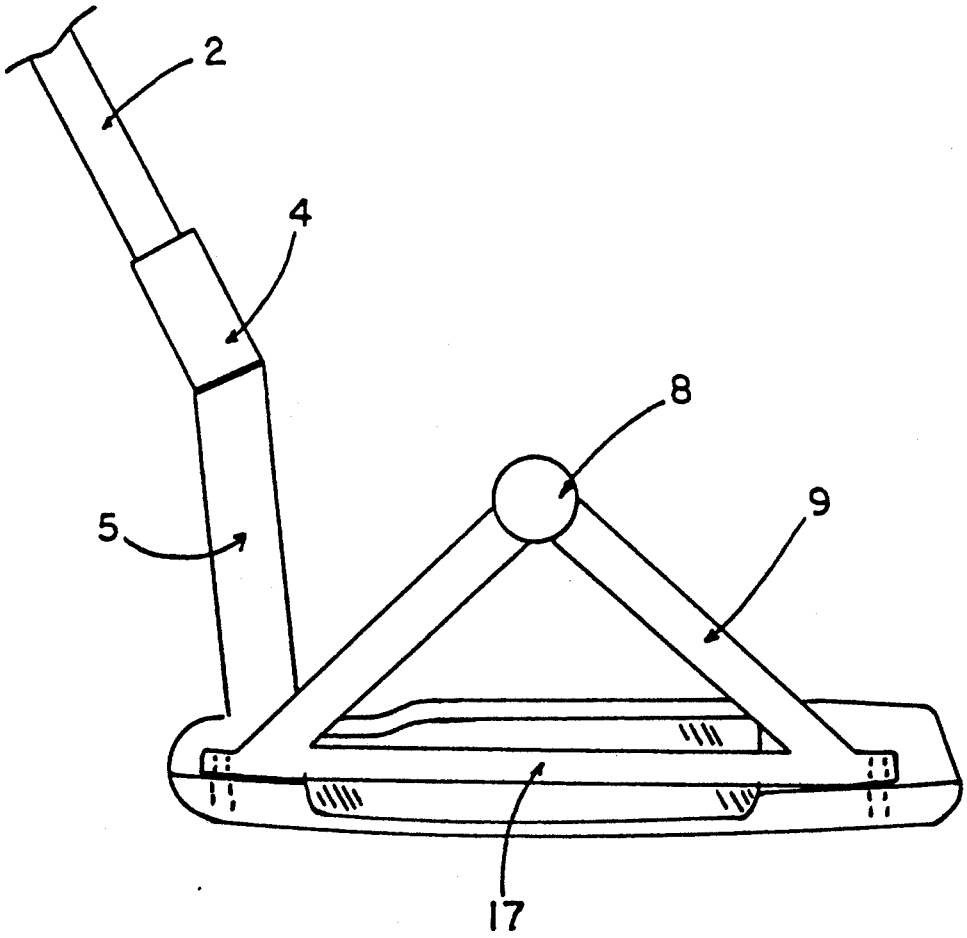
FIG. 5 is a rear view of the clubhead of a putter with a second application of my laser alignment invention thereon.

FIG. 5 shows another potential variation in the laser emission attachment means within the contemplation of this invention. The laser emission attachment means shown in FIG. 5 has an additional cross support member 17 between the bases of support members 9.

As stated above, the laser emission attachment means can be accomplished several ways within the contemplation of this invention, included attachment the shaft 2, the hosel 4 or the neck 5 of the golf club.

Figure 6:
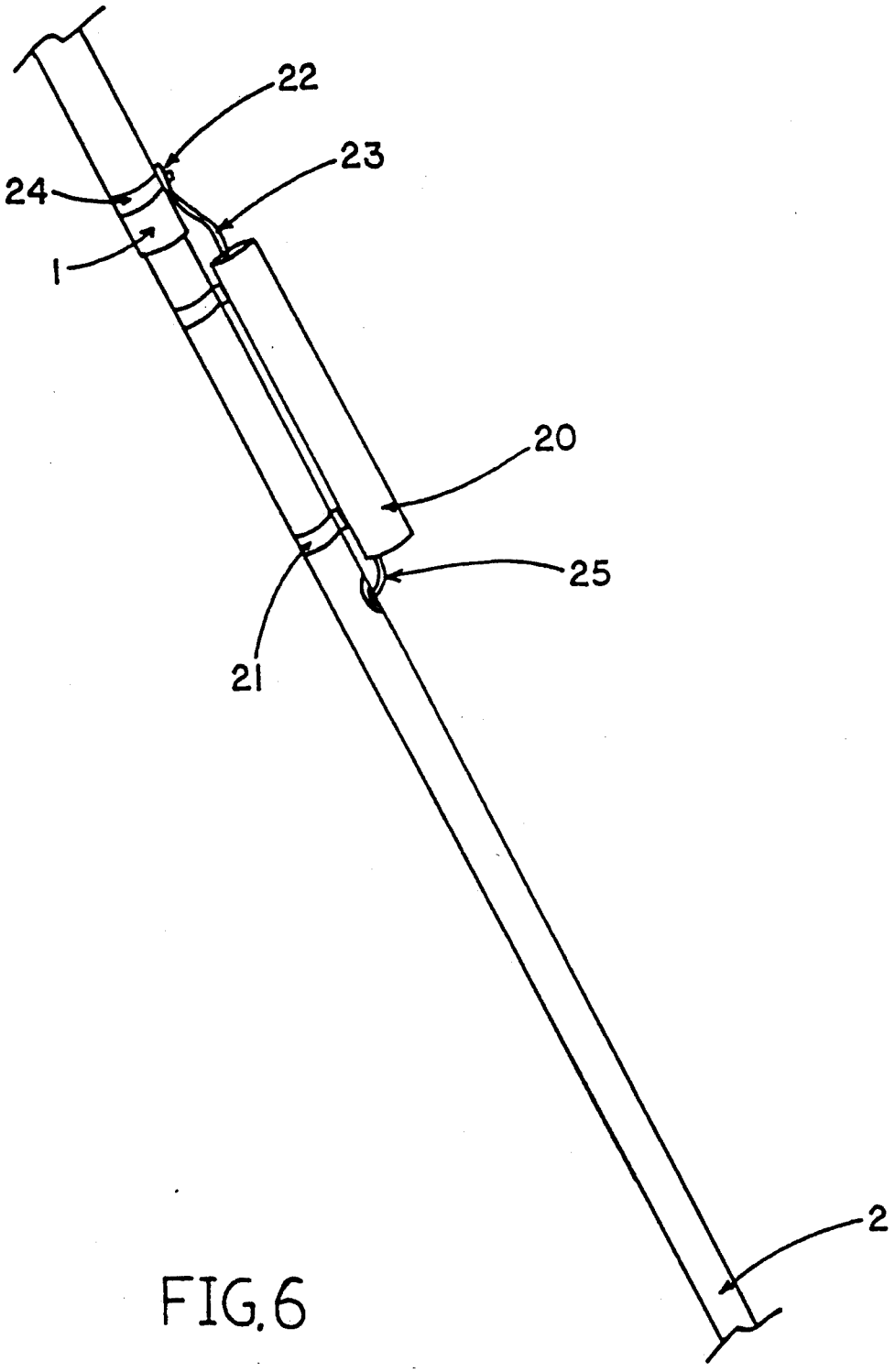
FIG. 6 shows a view of one of many possible housing means attached to the shaft of the golf club and with a pressure activated on/off control switch attached to and around the grip.

FIG. 6 shows one example or means to attach different components or variations of this invention to the golf club, and includes a housing means 20 attached to the shaft 2 by two clamps 21. FIG. 6 also shows a pressure activated on/off switch 22, attached to the grip 1 by a clamp 24, which requires that pressure be applied to the pressure activated on/off switch 22 and maintained in order to obtain energization of the lasing means.

The pressure activated on/off switch 22 is conductively connected to the power source or electrical circuit in the housing means by electrical wires 23 shown in FIG. 6.

A primary on/off switch is also an option with this invention and which must be in the on position before the pressure activated switch can control the energization of the lasing means. This and other variations can be utilized for additional control.

If a housing means 20 attached to the shaft 2 is utilized, then it must be conductively connected to the lasing means if the lasing means is attached to the clubhead 3, and must be optically connected by fibre optic cable to the means to emit the laser beam if the lasing means is also contained within the housing means 20 and only the means to emit the laser beam is attached to the clubhead 3. The wiring 25 can be either electrical wiring or fibre optic cable, depending on the specific configuration of the application of the invention used, and as described more fully herein.

The specific location or means of attachment of the different contemplated components of this invention can be varied within the contemplation of this invention.

Figure 7:
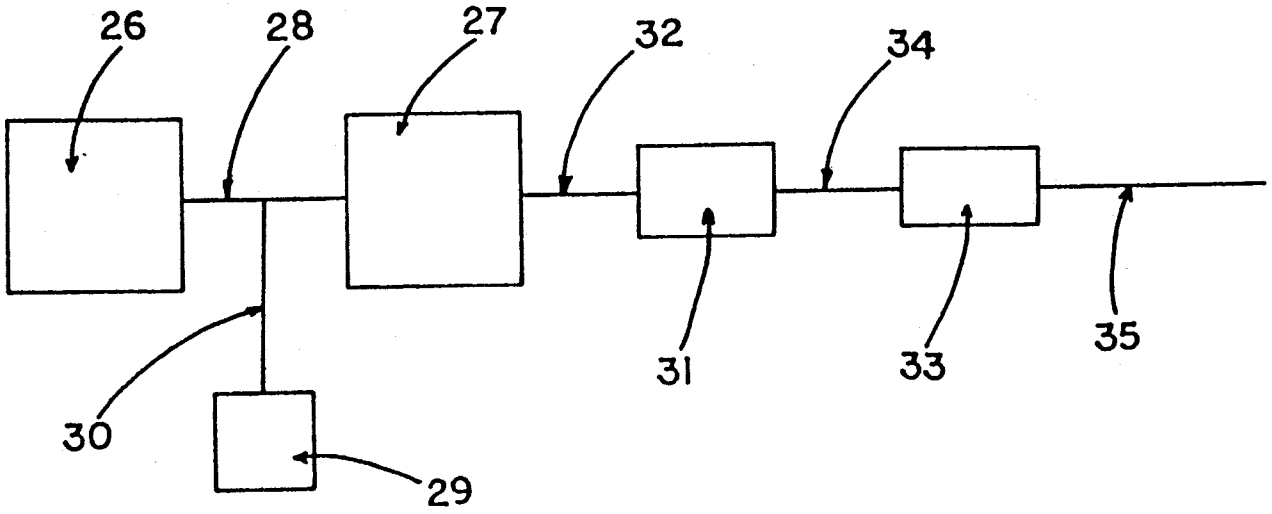
FIG. 7 is a block diagram of the elements of one application of my invention.

FIG. 7 shows a block diagram of the different elements of one application of the laser alignment system. The means to provide electrical current 26 to the lasing means is generally preferred to be a battery means, and several different combinations and type of batteries can be used, depending on the operating life desired of the battery and the power requirements of the lasing means utilized.

The means to provide electrical current 26 is conductively connected to the electrical circuitry means 27 by conduction means 28. The on/off switching means 29 is conductively connected to the conduction means 28 by conduction means 30.

The on/off switching means 29 can be a number of different combinations to turn the laser on and off and can include various features added for safety. In the preferred means, there is a master on/off switch which can be a toggle or snap switch, with a secondary pressure activated switch as described above in reference to FIG. 6.

Figure 11:
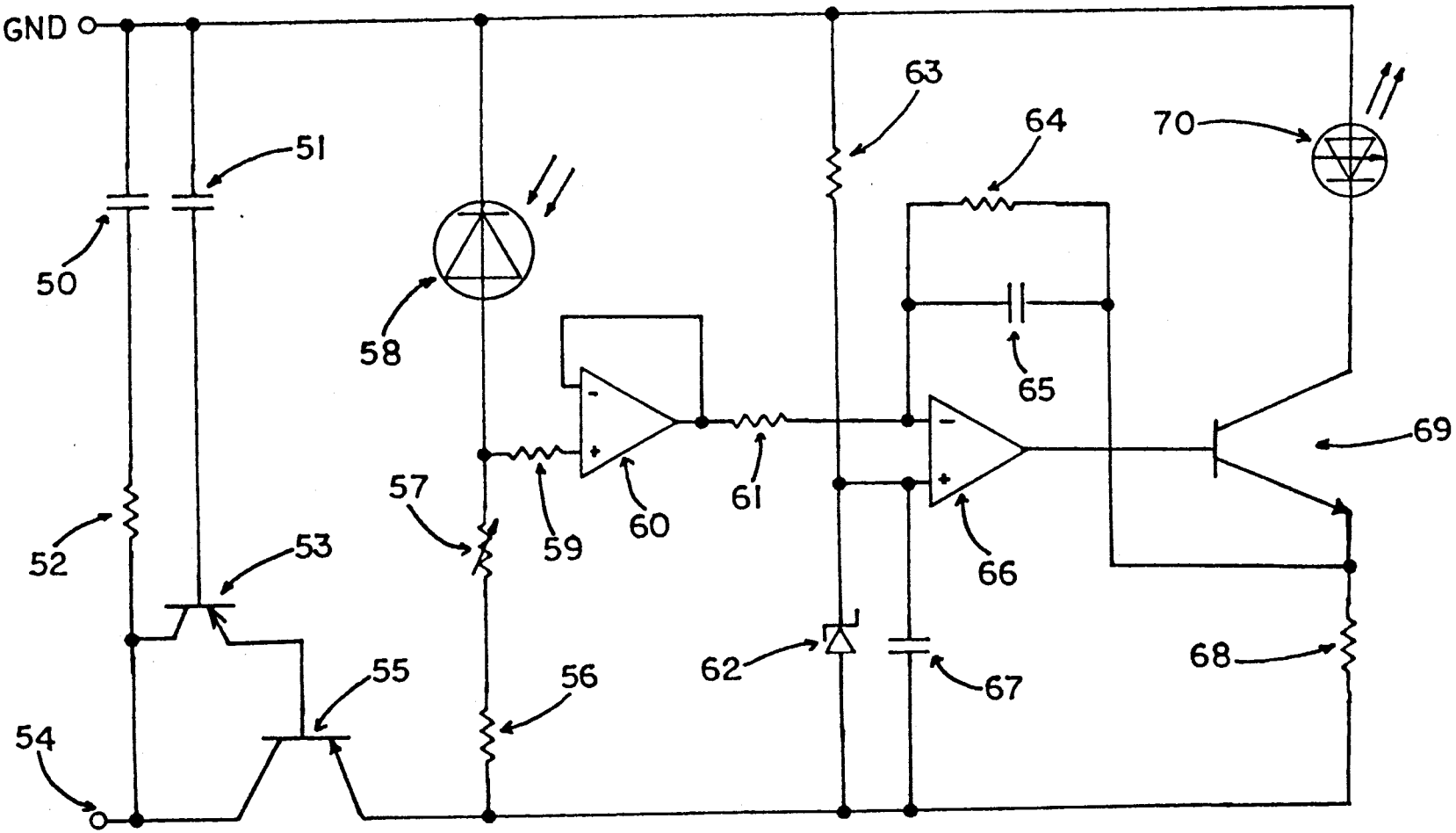
FIG. 11 is a circuit diagram depicting one example of driving circuit for the diode laser.

The electrical circuitry means 27 is circuitry designed to receive and control the electrical current received and to protect the lasing means. By way of example and as discussed more fully herein, FIG. 11 shows one of many possible circuits and one recommended by Toshiba as a possible driving circuit for its 9200 series diode lasers.

The electrical circuitry means 27 within the contemplation of this invention can be located in numerous different locations, such as in the housing means 20 shown in FIG. 6, or self contained within a laser module and combined therein with the lasing means and optical means, a laser module package which can be purchased as a module package from Applied Laser Systems of Grants Pass, Oregon.

Figure 9:
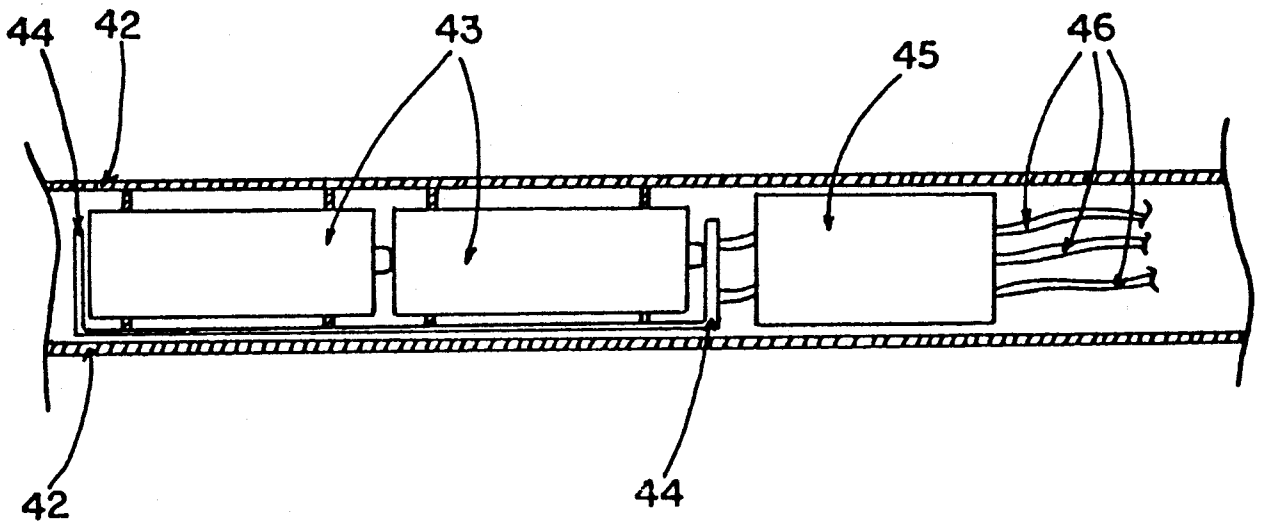
FIG. 9 is a cross sectional view of one application of the housing means from FIG. 6 or utilizing the shaft as the housing means, with various components of my invention therein.
Figure 10:
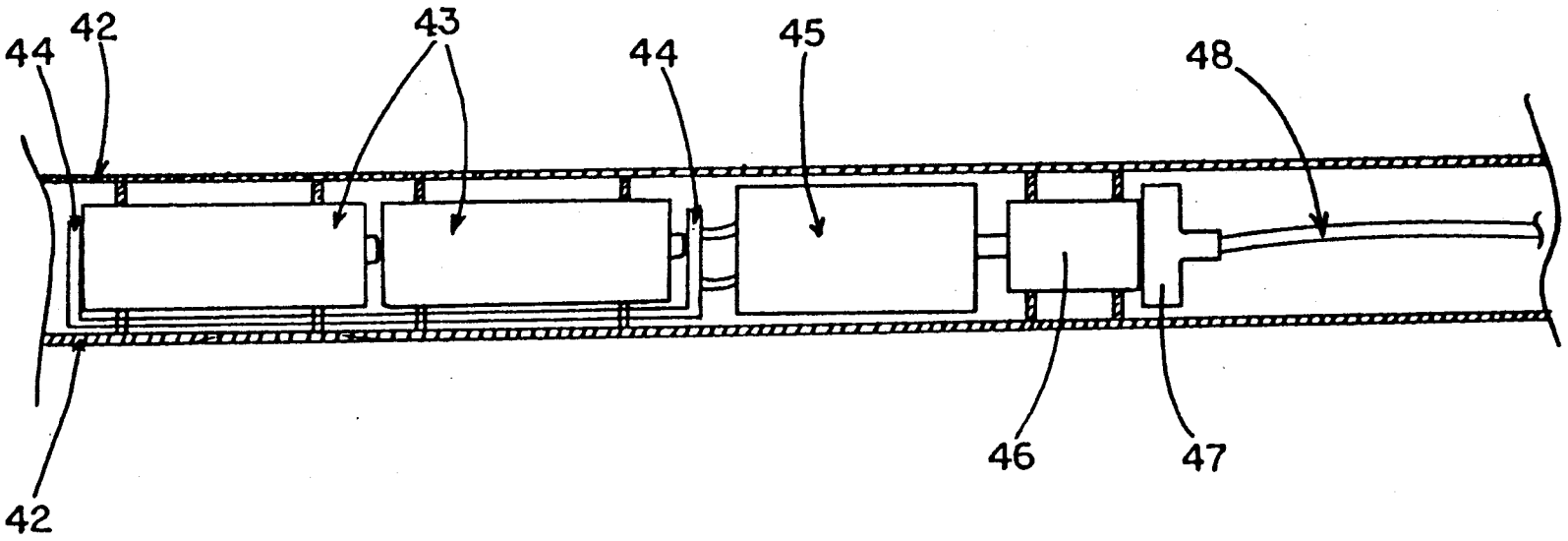
FIG. 10 is a cross sectional view of one application of the housing means from FIG. 6 or utilizing the shaft as the housing means, with various components of my invention wherein fibre optics are used to allow the lasing means to be located remote from the point of emission of the laser beam.

This invention also contemplates that instead of utilizing a housing means external to the shaft 2 as shown in FIG. 6, that the components can be located within the interior of the shaft 2, which FIGS. 9 & 10 would therefore also depict.

FIG. 7 further shows in the abstract the lasing means 31 conductively connected to the electrical circuitry 27 by conduction means 32, and optically connected to the optical means 33 by optical transmission means 34. The laser beam 35 is then emitted from the optical means.

The lasing means 31 within the contemplation of this invention can be located in numerous positions, such as within the laser emission housing 8 shown in FIGS. 2, 3 & 4, within the housing means 20 shown in FIG. 6, or within the shaft 2 as described more fully herein.

The optical means 33 can be a multitude of different lens combinations depending on the lasing means utilized and depending on whether it is desired to collimate, polarize or otherwise manipulate the laser beam received from the lasing means, and also, depending on the specific lasing means utilized. The selection of the desired optical means 33 will also depend on whether the lasing means is located remote from the point of emission of the laser beam and whether fibre optic cable is utilized to transmit the laser beam to its point of emission.

Figure 8:
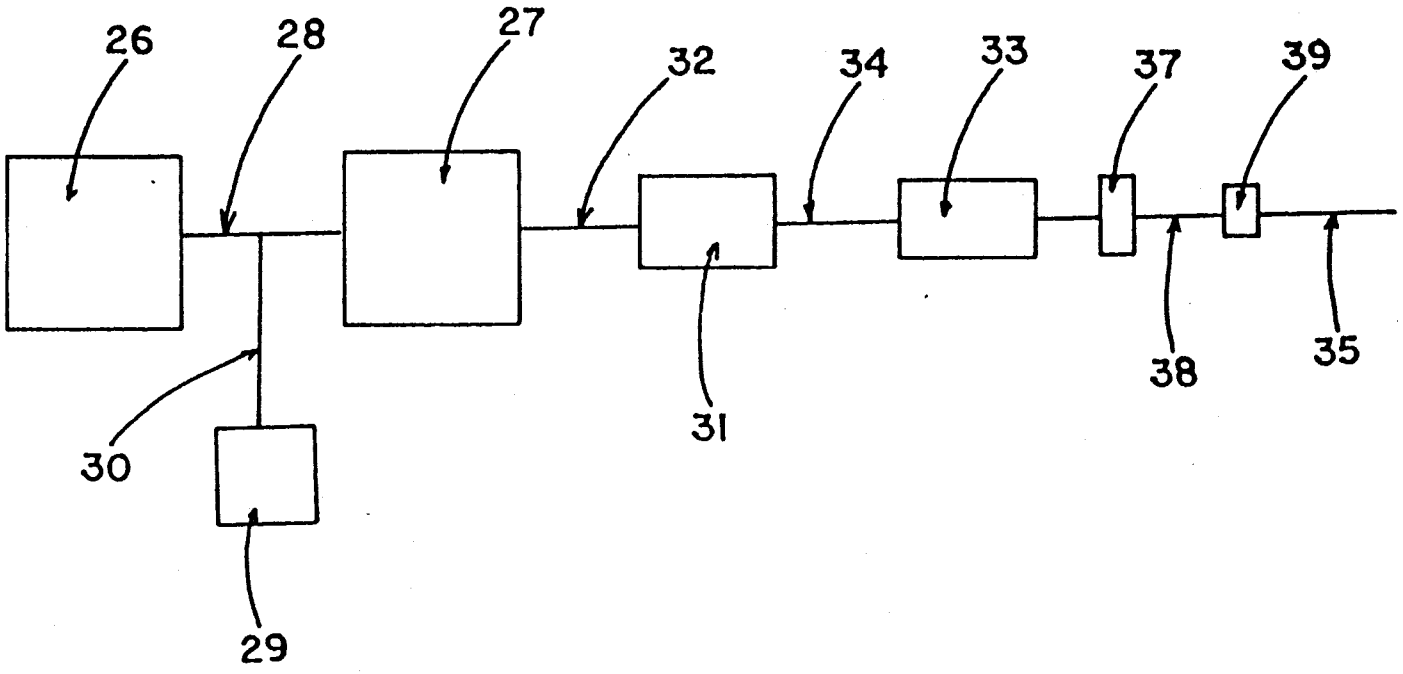
FIG. 8 is a block diagram of the elements of one application of my invention wherein the lasing means is located remote from the point of emission of the laser beam and fibre optics are used to transmit the laser beam to its point of emission.

FIG. 8 shows a block diagram of the different elements of one application of the laser alignment system wherein the lasing means 31 and optical means 33 are located remote from the means to emit the laser beam, such as when the lasing means may be located within the shaft 2 or within the housing means 20 shown in FIG. 6. FIG. 8 contains many of the same elements, but also includes a means to optically connect the lasing means 31 to the means to emit the laser beam.

The means to optically connect the lasing means 31 to the means to emit the laser beam generally includes a fibre optic coupler 37 which couples and aligns the laser beam from the lasing means to and with a fibre optic cable 38. The fibre optic cable 38 transmits the laser beam to the laser beam emission coupler 39, which then emits the emitted laser beam 35 at the desired location and in the intended direction.

There are numerous fibre optic couplers 37, fibre optic cables 38 and fibre optic emission couplers 39 commercially available and they will not therefore be discussed in significant detail.

FIG. 9 shows a sample configuration of certain elements of my invention as they could be contained within the housing means 20 shown in FIG. 6, within a shaft 2 or in other possible housing configurations, when the lasing means, the optical means and the means to emit the laser beam are attached to the clubhead and the electrical circuitry and the means to provide an electrical current are located remote from the clubhead 3.

It should be noted that this invention also contemplates locating and attaching all the elements to clubhead, for instance where a mallet type putter head is used, or when this invention is applied to a wood style clubhead. In such an application, smaller disc-shaped batteries can be utilized for their light weight and all the components can be located within or on the clubhead.

FIG. 9 is a cross sectional view of one application, and shows the wall 42 of the particular housing utilized (the housing means 20 shown in FIG. 6 or the wall of the shaft 2), two batteries 43 arranged in series in a typical battery housing 44, an electrical circuitry means 45 and three conduction means 46 which conductively connect the electrical circuitry means to the lasing means wherein it is located on the clubhead 3.

FIG. 10 shows a sample configuration of certain elements of my invention as they could be contained within the housing means 20 shown in FIG. 6, within a shaft 2 or in other possible housing configurations, when the lasing means and optical means are to be located remote from the means to emit the laser beam.

FIG. 10 shows many of the same components as FIG. 9, but further locates both the lasing means and the optics means within box 46, a fibre optic coupler 47 and a fibre optic cable 48. The lasing and optics means represented by item 46 can be put together in a number of ways or purchased commercially from Applied Laser Systems of Grants Pass, Oregon.

FIG. 11 shows one of many possible circuits and one recommended by Toshiba as a possible driving circuit for its 9200 series diode lasers. The circuit in FIG. 11 is self explanatory. However, Toshiba's recommended driving circuit contains the following recommended or exemplary values, types, sizes, ratings or descriptions of the components contained therein:

| Component | Description |
|---|---|
| Capacitor 50 | 47 uF |
| Capacitor 51 | 0.047 uF |
| Capacitor 65 | 0.1 uF |
| Capacitor 67 | 0.022 uF |
| Resistor 52 | 10k Ohms |
| Resistor 56 | 2.2k Ohms |
| Resistor 59 | 220k Ohms |
| Resistor 61 | 2.2k Ohms |
| Resistor 63 | 1k Ohms |
| Resistor 64 | 220k Ohms |

The laser diode 70 and photodiode 58 are also shown in FIG. 11, as well as a voltage level designation 54 of twelve volts.

Figure 12:
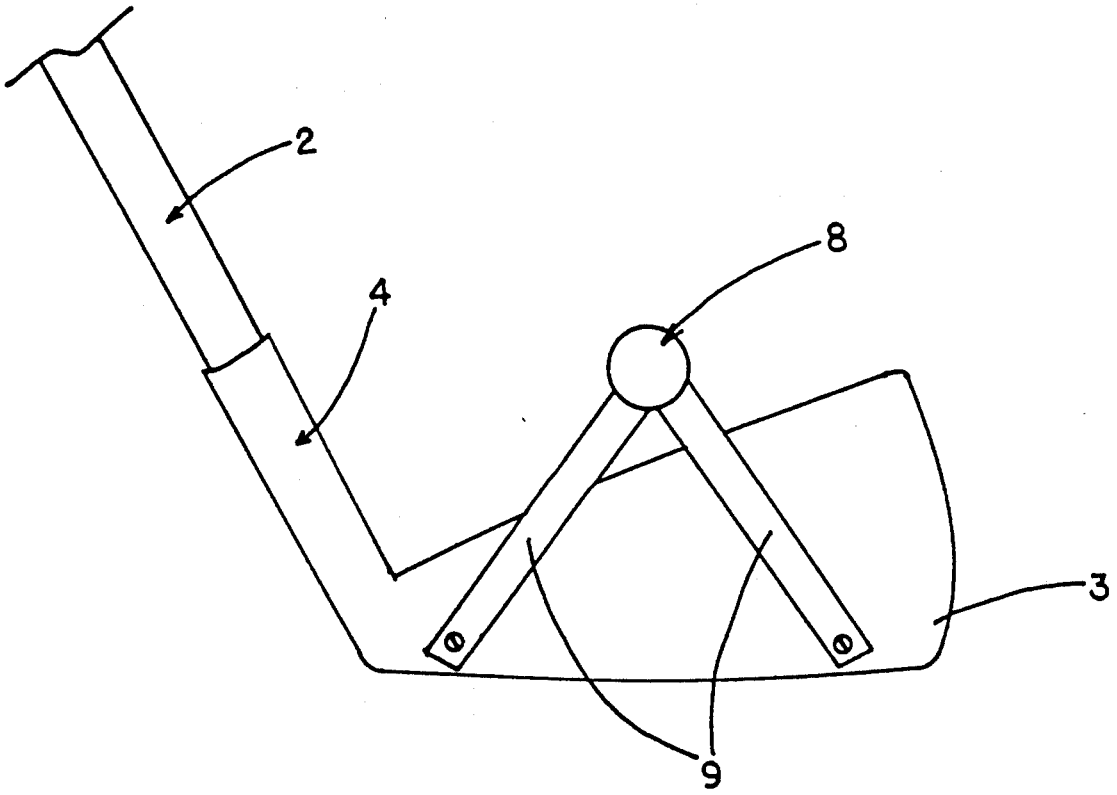
FIG. 12 is a golf club referred to as an iron, with the laser beam alignment system invention thereon.

FIG. 12 shows a golf club referred to as an iron, with the laser beam alignment system invention thereon, and the components as numbered as described more fully herein.

Figure 13:
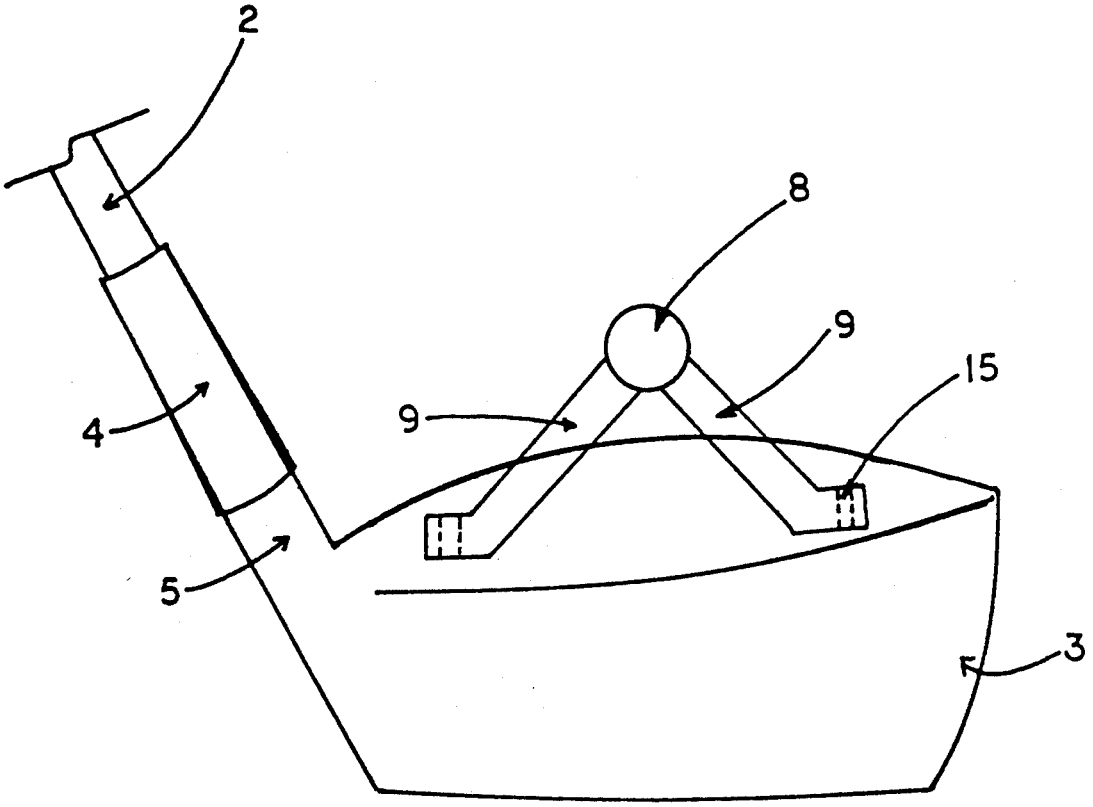
FIG. 13 is a golf club referred to as a wood, with the laser beam alignment system invention thereon.

FIG. 13 shows a golf club referred to as a wood, with the laser beam alignment system invention thereon, and the components as numbered as described more fully herein.

The active part of this invention is the generation of a laser beam with sufficient directional properties and sufficiently low diffusion, that the resulting visible beam, spot or dot generated by the laser beam can be seen by the unaided eye of the golfer. There may be some washout of the laser beam in the higher wavelengths by the sun, such as for laser beams in the six hundred seventy nanometer (nm) wavelength range. Lasing means producing wavelengths in the six hundred twenty nanometer to six hundred sixty nanometer wavelengths should provide a higher beam, dot or spot less susceptible to washout by the sun.

The means to generate a laser beam is generally comprised of two components, namely a lasing means and a means to provide an electrical current to said lasing means.

Although there are many different prospective lasing means to generate an acceptable laser beam within the contemplation of my invention, in order to be more ergonomically acceptable, there are only really a few types of lasing means today which meet the optimum criteria for light weight, lower relative cost and lower relative power consumption.

The preferred lasing means is a semiconductor type lasing means and, more particularly, a diode lasing means. Laser diodes such as those manufactured and distributed by Toshiba, such as Toshiba's 9200 series of laser diodes, can be used. The preferable lasing means will generate a laser beam with a wavelength in the six hundred nanometer to seven hundred nanometer wavelength range, although a specific wavelength is not necessary to practice this invention.

An optical means is used to perform different functions on the beam as it comes directly from the lasing means, such as collimation, polarization, etc., which are all well known in the laser art and commercially available, and will not therefore be discussed in significant detail. These functions are typically performed by one or more lens. Further, the pre packaged modules discussed herein can be purchased with the optical means built into the module.

Semiconductor laser diodes are very sensitive to different unintended types of electrical energy, such as static electricity, excessive current, current surges, etc. Further, the characteristics and the operation of laser diodes are greatly affected by the temperature of operation and hence heat sinks can be very important, depending on the specific application and operating conditions.

There are also certain control circuits that are recommended for such laser diodes, such as the circuit shown in FIG. 11 and as recommended by Toshiba for protection of its laser diodes.

There are manufacturers of laser diode modules that will sell the combination of the laser diode, the control circuitry, the heat sink means and the optic means in a small cylinder. These modules can come packaged as a small cylinder with two electrical leads protruding out the back. An example of such a product and company is the VLM laser diode modules manufactured by Applied Laser Systems of Grants Pass, Oregon.

The means to provide an electrical current as contemplated within the scope of this invention can be accomplished in many ways which are known in the field of art and in the industry. This may include anything from an adapter to convert power from a typical alternating current wall circuit to usable current, to a number of different types of battery configurations.

The preferred means involves the use of a battery configuration for portability. The means to provide an electrical current as contemplated within the scope of this invention can also be located in a number of different locations. These potential locations include on the clubhead, on the shaft in a housing means or within the shaft. Locating the batteries on or in the upper part of the shaft tends to minimize the impact of the weight of the batteries on the swing and feel of the club.

The preferred switch means is a pressure activated push button on/off switch means located on or very near the grip means of the club, on which pressure must be maintained in order to continue to provide electrical current to the lasing means. Locating the switch means on or near the grip means makes it reachable by the golfer's hands from their normal location on the grip and allows the golfer to alternately energize and de-energize the lasing means as he or she chooses and while standing over the ball and attempting to achieve the correct alignment.

Locating the pressure activated push button on/off switch means on the grip near the golfer's hands will allow the golfer to establish what he or she believes the correct alignment to be and then to energize the lasing means to determine if his or her visual alignment is correct, or the inaccuracy. This also then allows the golfer to de-energize the lasing means before swinging the club to avoid distraction from the laser beam.

While the preferred embodiment for the invention has been described in detail, those familiar with the art to which this invention relates will recognize various alternative designs and embodiments for carrying out the invention, as defined by the claims which follow.

The invention claimed is:

1. A golf club with a laser beam alignment system, comprising:

a. a shaft means 2;

b. a grip means 1 affixed to and around one end of said shaft means 2;

c. a clubhead 3 affixed to said shaft means 2 at the end of the shaft mans 2 opposite the grip means 1, and which includes a clubface 6;

d. a means to generate a laser beam;

e. a means to emit a laser beam which is communicatively connected to the means to generate the laser beam; and f. a laser beam emission attachment means, which attaches the means to emit a laser beam to the clubhead 3, and which locates the emission of the laser beam in a direction perpendicular to and above the clubface 6 and above an approximate location on the clubface 6 where it is desired to strike a golf ball, and which results in the emission of the laser beam in a substantially horizontal plane over the top of the golf ball when the golf club is held for addressing the ball on a substantially horizontal surface.

2. A golf club as recited in claim 1 wherein the means to generate a laser beam is comprised of a lasing means 31 conductively connected to a means to provide electrical current to said lasing means 31.

3. A golf club as recited in claim 2 and in which the means to provide electrical current to said lasing means 31 is a battery means.

4. A golf club as recited in claim 2 and in which the means to provide electrical current to said lasing means 31 further comprises a pressure activated switch means 22 which:

a. when not activated, prevents the transmission of electrical current to said lasing means 31; and b. which, when activated, allows the transmission of electrical current to said lasing means 31.

5. A golf club as recited in claim 2 and which is further comprised of an electrical control circuit means 45 located between the means to provide electrical current to the lasing means 31, and the lasing means 31, and which controls input current to the lasing means 31 and protects against fluctuations in the input current to the lasing means 31.

6. A golf club as recited in claim 1 wherein the means to generate a laser beam is comprised of a semiconductor lasing means 31 conductively connected to a means to provide electrical current to said semiconductor lasing means 31.

7. A gold club as recited in claim 6 and in which the means to provide electrical current to said semiconductor lasing means 31 is comprised of a battery means conductively connected to the semiconductor lasing means 31.

8. A golf club as recited in claim 7 and in which the means to provide electrical current to said semiconductor lasing means 31 further comprises a pressure activated switch means 22 that:

a. when not activated, prevents the transmission of electrical current to said semiconductor lasing means 31; and b. when activated, allows the transmission of electrical current to said semiconductor lasing means 31.

9. A golf club as recited in claim 1 wherein the means to generate a laser beam is comprised of a diode lasing means 31 conductively connected to a means to provide electrical current to said diode lasing means 31.

10. A golf club as recited in claim 9 and which is further comprised of an electrical control circuit means 45 located between the means to provide electrical current to the lasing means 31, and the lasing means 31, and which controls input current to the lasing means 31 and protects against fluctuations in the input current to the lasing means 31.

11. A golf club as recited in claim 9 and in which the means to provide electrical current to said diode lasing means 31 is comprised of a battery means conductively connected to the diode lasing means 31.

12. A golf club as recited in claim 9 and in which the means to provide electrical current to said diode lasing means 31 further comprises a pressure activated switch means 22 that:

a. when not activated, prevents the transmission of electrical current to said diode lasing means 31; and b. when activated, allows the transmission of electrical current to said diode lasing means 31.

13. A golf club as recited in claim 1 wherein the means to generate a laser beam is attached to the clubhead 3.

14. A golf club as recited in claim 1, which further comprises an optical means 47 to focus the laser beam exiting the lasing means 31, before it is emitted.

15. A golf club as recited in claim 1, wherein the means to generate a laser beam is located remote from its point of emission, and is transmitted from the means to generate a laser beam to its point of emission through an optic fibre coupling means and through an optical fibre 48.

16. A golf club as recited in claim 15, wherein an optical means 47 receives the laser beam from the means to generate said laser beam and manipulates the laser beam to better facilitate its transmission through the optic fibre coupling means and through the optical fibre 48.

17. A golf club as recited in claim 16, which further comprises an emission optical means 47 which receives the laser beam from the optic fibre and manipulates it for desired effects in its emission.

18. A gold club with a laser beam alignment system, comprising:

a. a shaft means 2;

b. a grip means 1 affixed to and around one end of said shaft means 2;

c. a clubhead 3 affixed to said shaft means 2 at the end of the shaft means 2 opposite the grip means 1, and which includes a clubface 6;

d. a lasing means 31 conductively connected to an electrical circuit mans which controls the drives the lasing means 31 and which contains a switching means of reenergizing and deenergizing the lasing means 31;

e. a means to provide electrical current to said lasing means 31 which is conductively connected to said electrical circuit means;

f. a means to emit a laser beam which is communicatively connected to the lasing means 31; an g. a laser beam emission attachment means, which attaches the means to emit a laser beam to the golf club, and which locates the emission of the laser beam in a direction perpendicular to and above the clubface 6 and above an approximate location on the clubface 6 where it is desired to strike a golf ball, and which results in the emission of the laser beam in a substantially horizontal plane over the top of the golf ball when the golf club is held for addressing the ball on a substantially horizontal surface.

19. A golf club as recited in claim 18 wherein the means to provide electrical current to said lasing means 31 is a battery means.

20. A golf club with a laser beam alignment system, comprising:

a. a shaft means 2;

b. a grip means 1 affixed to and around one end of said shaft means 2;

c. a clubhead 3 affixed to said shaft means 2 at the end of the shaft means 2 opposite the grip means 1, and which includes a clubface 6;

d. a lasing means 31 conductively connected to an electrical circuit means which controls and drives the lasing means 31 and which contains a switching means for energizing and deenergizing the lasing means 31;

e. a means to provide electrical current to said lasing means 31 which is conductively connected to said electrical circuit means;

f. an optics means communicatively connected to said lasing means 31 such that it receives a laser beam exiting said lasing means 31 and manipulates it as desired;

g. an optical fibre coupling means communicatively connected to said optics means and such that is receives the laser beam from said optics means and transmits it into an optic fibre means;

h. a means to emit a laser beam which is communicatively connected to the optic fibre means; and i. a laser beam emission attachment means, which attaches the means to emit a laser beam to the golf club, and which locates the emission of the laser beam in a direction perpendicular to and above the clubface 6 and above an approximate location on the clubface 6 where it is desired to strike a golf ball, and which results int eh emission of the laser beam in a substantially horizontal plane over the top of the golf ball when the golf club is held for addressing the ball on a substantially horizontal surface.

* * * * *